US006635320B2

(12) United States Patent
Wakata et al.

(10) Patent No.: US 6,635,320 B2
(45) Date of Patent: Oct. 21, 2003

(54) INK JET RECORDING SHEET

(75) Inventors: Yuichi Wakata, Shizuoka-ken (JP); Ryoichi Nakano, Shizuoka-ken (JP); Mizuki Yamamoto, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 9 days.

(21) Appl. No.: 09/906,081

(22) Filed: Jul. 17, 2001

(65) Prior Publication Data

US 2002/0064633 A1 May 30, 2002

(30) Foreign Application Priority Data

Aug. 7, 2000 (JP) ..... 2000-239015

(51) Int. Cl.[7] ..... B41M 5/00

(52) U.S. Cl. ..... 428/32.26; 428/32.28; 428/32.29; 428/32.32; 428/32.34

(58) Field of Search ..... 428/195, 206, 428/212, 331, 32.26, 32.28, 32.29, 32.32, 32.34

(56) References Cited

U.S. PATENT DOCUMENTS 5,570,120 A * 10/1996 Sakaki et al. ..... 347/105
5,576,140 A * 11/1996 Wakata et al. ..... 430/201
5,706,042 A * 1/1998 Takeyama et al. ..... 347/100
5,955,185 A * 9/1999 Yoshino et al. ..... 428/304.4
6,153,305 A * 11/2000 Uemura et al. ..... 428/478.2
6,156,419 A * 12/2000 Brugger et al. ..... 428/304.4
6,420,016 B1 * 7/2002 Peternell et al. ..... 428/195

FOREIGN PATENT DOCUMENTS

JP 57-36692 2/1982 ..... B41M/5/00
JP 1-188387 7/1989 ..... B41M/5/00
JP 8-244336 9/1996 ..... B41M/5/00
JP 10-180034 7/1998 ..... B01D/53/38
JP 10-217601 8/1998 ..... B41M/5/00
JP 11-20302 1/1999 ..... B41M/5/00

* cited by examiner

*Primary Examiner*—Cynthia H. Kelly
*Assistant Examiner*—B. Shewareged
(74) *Attorney, Agent, or Firm*—Sughrue Mion, PLLC

(57) ABSTRACT

It is an object of the present invention to provide an ink jet recording sheet which has high glossiness of the recording surface and is free from the bleeding of an image with time even under high temperature and humidity. Also, the recording sheet can avoid the occurrence of cracks, is strong, possesses high ink-absorbing ability, and can form an image with high light resistance and water resistance. The ink jet recording sheet comprises a polymer which contains a quaternary ammonium base in its molecule, of which the ratio of inorganicity/organicity (I/O value) calculated based on an organic conceptual diagram is 1.0 or less and the cation density (meq/g) is 3.0 or less, and which is soluble in at least one of water and an organic solvent.

18 Claims, No Drawings

INK JET RECORDING SHEET

BACKGROUND OF THE INVENTION

1. Field of the Invention

The present invention relates to a material for recording which is suitable to ink jet recording using liquid ink such as aqueous ink or oily ink or solid ink which is a solid at ambient temperature and is subjected to printing after it is melted and liquefied, and, particularly, to a recording sheet which has excellent ink receiving ability and is reduced in bleeding with time.

2. Description of the Related Art

Along with recent rapid development of information industries, a variety of information process systems have been developed. This is accompanied with the development of recording methods and equipment suitable to each information system and these methods and equipment have been put to practical use. Among these recording methods, an ink jet recording method is being widely used in home use as well as in offices because it enables recording in various recording materials and the hardware used in this method is relatively inexpensive, compact and has high soundless characteristics.

Also, along with the recent progress in high-resolution ink jet printers, so-called photograph-like high quality recorded materials have come to be available. In addition, along with the development of hardware (equipment), various recording sheets for ink jet recording are being developed.

The general characteristics required for such recording sheets are, for example, as follows: (1) it must have quick drying properties (the rate of absorption of ink must be high), (2) the diameter of an ink dot must be proper and uniform (any bleeding does not occur), (3) it must have good granularity, (4) the circularity of a dot must be high, (5) the color density must be high, (6) the chroma must be high (the color must not be subdued), (7) the light resistance and water resistance of an image portion must be high, (8) even if it is stored for a long time, it is resistant to the bleeding of an image, (9) it must have high whiteness, (10) it must have high preservation ability, (11) it must have high resistance to deformation and good dimensional stability (curling is sufficiently small) and (12) it has good running characteristics in a hardware.

Moreover, besides the above characteristics, glossiness and surface smoothness are required and it is also required for a printed paper to have a texture similar to a silver salt photograph in applications for photo glossy paper to be used to obtain a photo-like high quality recorded material.

As recording sheets to be used for ink jet recording, those obtained by applying a pigment such as silica and a water-soluble binder to a support made of paper or a plastic film as described in, for example, the respective publications of Japanese Patent Application Laid-Open (JP-A) No. 55-51583, JP-A No. 55-144172, JP-A No. 55-150395, JP-A No. 56-148582, JP-A No. 56-148583, JP-A No. 56-148584, JP-A No. 56-148585, JP-A No. 57-14091, JP-A No. 57-38185, JP-A No. 57-129778, JP-A No. 57-129979, JP-A No. 60-219084 and JP-A No. 60-245588 are known. However, all of these proposed recording sheets have very low glossiness and are unsatisfactory for applications such as photo glossy paper.

Also, recording sheets using a pseudoboehmite sol and a water-soluble binder are proposed in the respective publications of JP-A No. 2-276670, JP-A No. 3-215082, JP-A No. 3-281383 and JP-A No. 6-199035. Although these recording sheets fulfill the requirements as to the gloss characteristics to some extent, there are, for example, the problems that the production cost of the pseudoboehmite is high and it is difficult to prepare a coating solution.

Further, proposed in JP-A No. 4-223190 is ink jet recording paper provided with a recording layer comprising 5 to 20 $g/m^2$ of synthetic silica and polyvinyl alcohol (PVA) on substrate paper coated with 0.1 $g/m^2$ of borax or boric acid. The aforementioned technologies are intended only to improve the film strength of a recording layer reduced in the content of a binder. The recording paper has inferior glossiness and is hence unsatisfactory for applications such as photo glossy paper.

Recording materials using various water-soluble polymers to impart glossiness are proposed. For example, those obtained by applying polyvinyl alcohol, polyvinylpyrrolidone or gelatin to a support made of paper or a plastic film as described in the respective publications of JP-A No. 58-89391, JP-A No. 58-134784, JP-A No. 58-134786, JP-A No. 60-44386, JP-A No. 60-132785, JP-A No. 60-145879, JP-A No. 60-168651 and JP-A No. 60-171143 are known. These recording sheets have superior glossiness, but are inferior in the rate of drying ink and are hence unsatisfactory for applications such as photo glossy paper.

On the other hand, ink jet recording sheets which fulfill the aforementioned requirements as to the characteristics of ink jet recording sheets and as to the production cost are proposed in the respective publications of JP-A No. 7-276789, JP-A No. 8-174992, JP-A No. 11-115308 and JP-A No. 11-192777.

In the above publication of JP-A No. 7-276789, a recording sheet is proposed in which a colorant receptor layer formed of an inorganic pigment fine particle and a water-soluble resin and having a three-dimensional structure having a high void ratio is disposed on a support. This structure is said to ensure that the aforementioned ink-absorbing ability is improved and color mixing bleeding in printing is sufficiently suppressed whereby a high-resolution image can be obtained. This colorant receptor layer may be formed by compounding a large amount of particles having a small size. It is necessary to decrease the amount of a binder used for the formation of a layer so that voids are formed. Therefore, this sheet has the drawback that cracks occur if the coating layer is dried quickly, thereby damaging the transparency and appearance of the colorant receptor layer.

As a method used to prevent cracks of the ink receptor layer, a method in which the viscosity of a binder in a coating solution is increased is proposed in JP-A No. 9-109545. In this method, however, there is the fear of reduced workability and occurrence of uneven coating, showing that this method does not reach a practically effective level.

A method of preventing cracks by using a coating solution comprising an inorganic particle, polyvinyl alcohol (PVA) and boric acid or borate is disclosed in the respective publications of JP-A No. 7-76161 and JP-A No. 10-119423. In this method, also, a large reduction in workability is caused by a rise in the viscosity of the coating solution. This method also poses the problem of the inferior stability of the solution with time and does not reach a practically effective level.

An ink jet recording sheet provided with a colorant receptor layer, which comprises a fine inorganic pigment particle and a water-soluble resin and has a high void ratio, on a support is proposed in the respective publications of JP-A No. 10-119423 and JP-A No. 10-217601.

These ink jet recording sheets have good ink-absorbing ability and high ink-receiving ability enough to form a high-resolution image and exhibits high glossiness due to its structure. However, a support coated with a resin such as polyethylene on both sides thereof is used as the support in view of glossiness and texture, and therefore a high-boiling point solvent contained in the colorant receptor layer is not vaporized and the solvent is not absorbed in the support. Consequently, the high-boiling point solvent remains unremoved in the colorant receptor layer, giving rise to the problem that when the sheet is stored under high temperature and humidity after an image is printed, the solvent is diffused together with a dye in the colorant receptor layer, causing the bleeding of the image with time (hereinafter referred to as "bleeding with time" where necessary).

Also, it is widely adopted to add a compound having an amino group or an ammonium salt, especially, a polymer compound containing these group and salt with the intention of fixing a dye component in ink in the ink jet recording sheet.

For instance, many compounds are used, these compounds including (co)polymers of a diallylammonium salt derivative as disclosed in the respective publications of JP-A No. 60-83882, JP-A No. 64-75281 and JP-A No. 59-20696, allylamine salt copolymers as disclosed in the respective publications of JP-A No. 61-61887 and JP-A No. 61-72581, (meth)acrylates having an ammonium salt, (meth) acrylamide type polymers and vinyl (co)polymers such as a vinylbenzylammonium salt (co)polymer as disclosed in the respective publications of JP-A No. 6-340163, JP-A No. 4-288283, JP-A No. 9-300810, JP-A No. 8-318672, JP-A No. 10-272830 and JP-A No. 63-115780, modified polyvinyl alcohol (PVA) as described in, for example, JP-A No. 10-44588, amine/epichlorohydrin co-adduct as described in JP-A No. 6-23468, JP-A No. 11-277888, dihalide/diamine co-adduct as described in JP-A No. 10-119418 and polyamidines as described in the respective publications of JP-A No. 11-58934 and JP-A No. 11-28860. The use of these compounds is to fix a dye and to prevent bleeding.

However, because all of these compounds are water-soluble polymers basically, the water-soluble dye can be incompletely fixed and, particularly, an improvement in bleeding under high temperature and humidity has been insufficiently made yet.

Also, if the sheet is stored in a clear file or the like immediately after an image is printed, bleeding with time likewise occurs because the sheet is in the condition that water in ink and a high-boiling point solvent (glycerin and a diethylene glycol derivative) contained in a small amount in ink remain unremoved.

In the meantime, the ratio of inorganicity/organicity (I/O value) is known as one of indexes showing the magnitude of the polarity of a compound. Also, an index which is the equivalency of an ammonium salt per unit mass of a polymer solid and expressed by meq/g is called cation density. In the aforementioned publications, the ratio of inorganicity/organicity (I/O value) or the cation density (meq/g) is not prescribed in each compound added for the purpose of fixing the aforementioned dye component in ink. However, when such a value is calculated, the ratio of inorganicity/organicity (I/O value) is in the vicinity of 1.5 to 7.0 and the cation density (meq/g) is in the vicinity of 3.2 to 7.0. There is the case where the ratio of inorganicity/organicity (I/O value) is hereinafter simply called "I/O value".

Like the ink jet recording sheets as described in the respective publications of JP-A No. 57-36692, JP-A No. 10-180034, JP-A No. 11-20302 and JP-A No. 8-244336, ink jet recording sheets which contain an amino group and an ammonium salt like the aforementioned compound and contain a water-insoluble base latex are known. These ink jet recording sheets are improved in water resistance by using the hydrophobic latex.

However, in the ink jet recording sheets using such a hydrophobic latex, the hydrophobic latex must be compounded in a large amount to impart sufficient water resistance, giving rise to the problem that the light resistance of an image and miscibility with a pigment are resultantly impaired.

Also, many of these sheets use a crosslinkable monomer (specifically, a monomer having two or more polymerizable functional groups in its molecule) in order to form a latex of a hydrophilic monomer unit such as an amino group or an ammonium salt. Therefore, aqueous ink has difficulty in penetrating into the monomer particle and the ink-receiving ability is not sufficient. Moreover, in the case of using a receptor layer made of a porous film, the voids of the porous film are clogged, because a granular compound is added, thus inhibiting the ink absorbing ability.

Also, the latex using a crosslinkable monomer in this manner is insoluble in an organic solvent or the like and it is therefore difficult to handle it. In addition, examples of a part of latex using no crosslinkable monomer are known. Even in the case of such a latex compound, there are no descriptions concerning compounds having a low I/O value and a low cation density.

Further, a recording material comprising 1 mass % or more of a monomer unit containing a quaternary ammonium salt and a copolymer which is substantially insoluble in water is disclosed in JP-A No. 1-188387.

Such a compound surely exhibits an I/O value and cation density which are low to some extent. However, the I/O value of the compound used in the recording material is the order of 1.4 to 1.8 and there is no description of compounds having an I/O value lower than the above range and a low cation density. There is also no description concerning such a concept as to decrease the I/O value and the cation density. Further, there is also no description that the frequency of the occurrence of bleeding with time on an ink jet recording sheet is improved by adding such a compound.

Also, an example in which the ratio of inorganicity/organicity (I/O value) is prescribed in a compound is described in JP-A No. 10-217601. In this case, however, only nonionic copolymers other than ammonium salts are prescribed. Also, this method uses a unit having a high I/O value (high hydrophilic properties) as a copolymer unit, which is quite different from the concept intended to decrease the I/O value of the compound.

SUMMARY OF THE INVENTION

The inventors of the present invention have noted the inorganicity/organicity ratio and cation density of compounds added to fix the aforementioned dye component in ink to solve various problems in the prior art to thereby attain the following object.

It is an object of the present invention to provide an ink jet recording sheet which is free from bleeding with time and can keep an image stably even if it is stored for a long period of time under high temperature and humidity after an image is printed.

Another object of the present invention is to provide an ink jet recording sheet which can avoid the occurrence of cracks, is strong, has high surface glossiness, possesses high ink-absorbing ability, can form an image with high-resolution and high density, has good color-developing ability and is superior in light resistance and water resistance of an image portion.

The inventors of the present invention have made earnest studies to solve these problems and, as a result, found that these problems can be solved using an ink jet recording sheet having the following structures, resulting in the patent application of this case.

A first aspect of the present invention is an ink jet recording sheet comprising a polymer which contains a quaternary ammonium base in its molecule, of which the ratio of inorganicity/organicity (I/O value) calculated based on an organic conceptual diagram is 1.0 or less and the cation density (meq/g) is 3.0 or less and which is soluble in at least one of water and an organic solvent.

A second aspect of the present invention is an ink jet recording sheet provided with a colorant receptor layer on a support, the colorant receptor layer containing a polymer which contains an inorganic pigment fine particle, a water-soluble resin and a quaternary ammonium base in its molecule, of which the ratio of inorganicity/organicity (I/O value) calculated based on an organic conceptual diagram is 1.0 or less and the cation density (meq/g) is 3.0 or less and which is soluble in at least one of water and an organic solvent.

A third aspect of the present invention is an ink jet recording sheet according to the above aspect, wherein the colorant receptor layer is obtained by applying a first coating solution containing the inorganic pigment fine particle and the water-soluble resin to the support and by applying a second coating solution containing the polymer, at least at one time of (1) a time when the first coating solution is applied, (2) a time during drying the coating layer before the coating layer shows a falling drying rate and (3) a time after the coating layer has dried and formed a coating film.

DESCRIPTION OF THE PREFERRED EMBODIMENTS

The details of the present invention will be hereinafter explained.

<<Ink Jet Recording Sheet>>

(Polymer of which the Ratio of Inorganicity/Organicity and the Cation Density are Prescribed)

The ink jet recording sheet of the present invention comprises a polymer (hereinafter referred to as "polymer according to the present invention") which contains a quaternary ammonium base in its molecule, of which the ratio of inorganicity/organicity (I/O value) calculated based on an organic conceptual diagram is 1.0 or less and the cation density (meq/g) is 3.0 or less and which is soluble in at least one of water and an organic solvent.

Inorganicity/Organicity (I/O Value)

First, the ratio of inorganicity/organicity (I/O value) of the organic conceptual diagram will be explained. This value is an index showing the magnitude of polarity of a compound and described in, for example, Organic Conceptual Diagram (Yoshio Koda, Sankyo Shuppan (1984)). This technique is one of functional group contribution methods for setting a parameter for every functional group and the value of inorganicity and the value of organicity are shown for every functional group.

Here, a method of calculating an actual value of the ratio of inorganicity/organicity will be explained using the following structural Structural Formula (1)

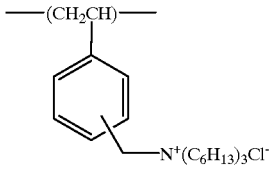

When the I/O value is calculated, it is assumed, for example, that the structural formula (1) consists of an ammonium salt and a benzene ring exhibiting inorganicity and 27 carbon atoms exhibiting organicity. Here, the respective values of the ammonium salt, benzene ring and carbon atom described in the organic conceptual diagram are 400, 15 and 20 respectively. In this case, although the value of a C1 atom is also described in the organic conceptual diagram, this value is reasonably considered to be the value of a covalently bonded Cl atom. A discussion will be followed using the value calculated on the premise that the contribution of the Cl ion in the above structural formula (1) is included in the ammonium salt. An instance of the calculation is shown below.

Instance of the Calculation of an I/O Value

Inorganicity 400 (ammonium salt)+15 (benzene ring)=415

Organicity 20 (carbon atoms)×27=540

Inorganicity/organicity=415/540=0.77

A small I/O value shows that the polarity of the compound is low. In order to accomplish the object of the present invention, it is necessary that the I/O value of a polymer which has a quaternary ammonium base and is soluble in at least one of water and an organic solvent be preferably 1.0 or less and more preferably 0.8 or less as a whole. When the I/O value is 1.0 or more, particularly the water resistance and the bleeding characteristics with time are impaired.

The lower limit of the I/O value is, though not particularly limited (because it depends upon the amount of the polymer to be applied), practically 0.1 or more and preferably 0.2 or more. An I/O value smaller than 0.1 results in coating difficulty.

Cation Density

Next, the cation density will be explained. This is equivalency of an ammonium salt per unit mass of a polymer solid and expressed, for example, by meq/g. In order to achieve the object of the present invention, it is necessary that the cation density of a polymer which has a quaternary ammonium base and is soluble in at least one of water and an organic solvent be preferably 3.0 or less and more preferably 2.5 or less as a whole. When the cationic density is 3.0 or more, the bleeding characteristics with time are impaired.

The lower limit of the cation density is, though not particularly limited (because it depends upon the amount of the polymer to be applied), practically 0.5 or more and preferably 1.0 or more. If the cation density is 0.5 or less, the dye is insufficiently fixed and therefore, the ink-absorbing ability and the resolution in a printing stage are decreased.

Polymer According to the Present Invention

In order to achieve the object of the present invention, both of the I/O value and cation density of the polymer which has a quaternary ammonium base in its molecule and is soluble in water or an organic solvent must fall within the above range. As a monomer unit forming such a polymer, a known quaternary ammonium base-containing monomer may be used independently or arbitrary units may be selected from known nonionic monomer units and combined. These units may be used either singly or in combinations of two or more.

Actually, given as specific examples of compounds fulfilling the above requirements are the compounds (polymer 1 to polymer 6) shown below, which, however, are not intended to be limiting of the invention.

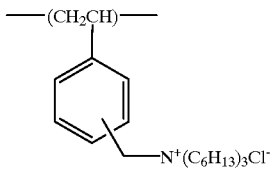

Polymer 1 (I/O value=0.77, cation density=2.37 meq/g)

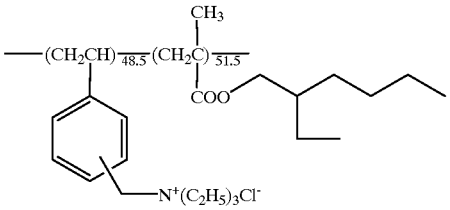

Polymer 2 (I/O value=0.86, cation density=2.39 meq/g)

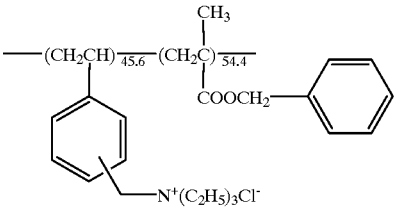

Polymer 3 (I/O value=0.90, cation density=2.39 meq/g)

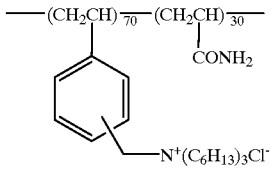

Polymer 4 (I/O value=0.86, cation density=2.21 meq/g)

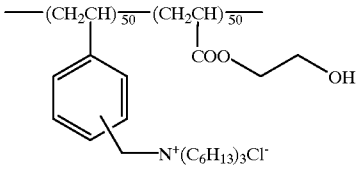

Polymer 5 (I/O value=0.90, cation density=1.85 meq/g)

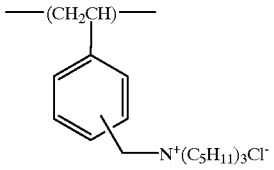

Polymer 6 (I/O value=0.87, cation density=2.63 meq/g)

The above compounds are obtained by homopolymerizing or copolymerizing a monomer corresponding to each repeat unit in a medium such as an organic solvent according to a usual method. Also, these compounds may be used either singly or as mixtures of two or more. The polymer according to the present invention is soluble in at least one of water and an organic solvent and the molecular weight of the polymer is preferably about 1000 to 500000 and more preferably 2000 to 400000 in terms of weight average molecular weight measured by gel permeation chromatography (GPC). If the molecular weight is less than 1000, the water resistance tends to be insufficient whereas if the molecular weight is 500000 or more, the handling qualities are inferior.

Here, "the polymer which is soluble in at least one of water and an organic solvent" is a polymer which is made hydrophobic overall and is any one of polymers which are (1) soluble in water and an organic solvent, (2) soluble in water but insoluble in an organic solvent or (3) insoluble in water but soluble in an organic solvent, specifically, the term carries an implication that polymers which are insoluble in water and an organic solvent are excluded.

Also, the above-mentioned term "soluble in an organic solvent" means that the polymer according to the present invention is soluble in an organic solvent or the like used when the polymer is applied. Examples of the organic solvent include alcohols such as methanol, ethanol, n—propanol, i—propanol and methoxy propanol, ketones such as acetone and methyl ethyl ketone, tetrahydrofuran, acetonitrile, ethyl acetate and toluene.

Also, one or two or more types of polymer (mordants) or low molecular weight compound containing a known quaternary ammonium salt or a tertiary amine may be used together as long as the use of these compounds does not impair the characteristics required for the recording sheet. The above mordant may be loosely classified into a polymer mordant and a non-polymer mordant. It is not required for these compounds to be those having, particularly, a low I/O value and a low cation density. As these compounds, a general (water-soluble in most cases) mordant may be used together without any problem.

Preferable examples of the polymer mordant may include polydiallyldimethylammonium chloride, polymethacryloyloxyethyl-β-hydroxyethyldimethylammonium chloride, polyethyleneimine, polyallylamine, polyallylamine hydrochloride, polyamide-polyamine resins, cationic starch, dicyandiamideformalin condensate, dimethyl-2-hydroxypropylammonium salt polymers, polyamidine and polyvinylamine. The molecular weight of each of these compounds is preferably about 1000 to 400000. If the molecular weight is less than 1000, the water resistance tends to be insufficient whereas if the molecular weight is 400000 or more, the viscosity is high and the handling qualities is therefore inferior.

On the other hand, as the non-polymer mordant, a compound in which the total number of carbon atoms is 12 or more and preferably 18 or more and which has a quaternary ammonium base is used.

Colorant Receptor Layer

The ink jet recording sheet of the present invention in which the polymer according to the present invention is singly disposed on the support may be used. It is preferable to use a recording sheet in which a colorant receptor layer containing an inorganic pigment fine particle and a water-soluble resin is further formed.

Another embodiment of the ink jet recording sheet according to the present invention is provided with a colorant receptor layer on a support, the colorant receptor layer containing a polymer which contains an inorganic pigment fine particle, a water-soluble resin and a quaternary ammonium base in its molecule, of which the ratio of inorganicity/organicity (I/O value) calculated based on an organic conceptual diagram is 1.0 or less and the cation density (meq/g) is 3.0 or less and which is soluble in at least one of water and an organic solvent.

In this case, the content of the polymer according to the present invention or the content of the sum of the polymer and a known mordant is preferably 0.5 to 25.0 mass % and more preferably 1.0 to 20.0 mass % of the total solid content of the colorant receptor layer.

If the above content is less than 0.5 mass %, sufficient water resistance and the effect of preventing bleeding with time cannot be obtained whereas if the content exceeds 25.0 mass %, this causes impaired ink-absorbing ability.

Inorganic Pigment Fine Particle

Examples of the inorganic pigment fine particle include a silica fine particle, colloidal silica, titanium dioxide, barium sulfate, calcium silicate, zeolite, kaolinite, halloysite, mica, talc, calcium carbonate, magnesium carbonate, calcium sulfate, boehmite and pseudoboehmite. Among these compounds, silica fine particle is particularly preferable.

The above silica fine particle has the characteristics that because it has a particularly large specific surface area, it possesses high ink-absorbing ability and ink-retentive efficiency and also because it has a low refractive index, transparency is imparted to the colorant receptor layer if it is dispersed until it has a proper particle diameter thereby obtaining a high color density and good color developing ability. It is of importance that the colorant receptor layer is transparent with the view of obtaining high color density and good color developing ability not only in applications such as an OHP requiring transparency but also in the case of applying to recording sheets such as photo glossy paper.

The average primary particle diameter of the aforementioned inorganic pigment fine particle is preferably 20 nm or less, more preferably 10 nm or less and particularly preferably 3 to 10 nm.

The above silica fine particles have a silanol group on their surfaces and tend to adhere to each other by hydrogen bonding due to the silanol group. Therefore, when the average primary particle diameter is 10 nm or less as aforementioned, a structure having a large void ratio can be formed. This makes it possible to improve the ink-absorbing ability efficiently.

Also, the silica fine particles are roughly classified by production methods into wet-method particles and dry-method particles.

In a main method among the above wet method, active silica is generated by acid-decomposition of a silicate. The active silica is then polymerized moderately and subjected to coagulation sedimentation to obtain hydrate silica. On the other hand, main methods among the dry method include a method using high temperature vapor phase hydrolysis (flame hydrolysis method) of silicon halide and a method (arc method) in which quartz sand and cokes are reduced and vaporized under heat by an arc in an electric furnace, followed by oxidizing the vaporized product by using air to obtain a silica anhydride.

Hydrate silica and silica anhydride obtained in these methods exhibit qualities different from each other because there is a difference in, for example, the density of the silanol group on the surface and existence of pores in the silanol group. Silica anhydride (silicate anhydride), in particular, tends to form a three-dimensional structure and is therefore desirable. This reason is not clarified. However, in the case of hydrate silica, the density of the silanol group on the surface of the fine particle is as many as 5 to 8/nm$^2$, so that the silica fine particles tend to aggregate at high density. On the contrary, in the case of silica anhydride, the density of the silanol group is as small as 2 to 3/nm$^2$, so that the fine particles are made into a non-dense flocculate. As a result, it is estimated that silica anhydride has a structure having a high void ratio.

Accordingly, in the present invention, it is desirable to use silica (silica fine particle) in which the density of a silanol group on the surface of the fine particle is 2 to 3/nm$^2$.

Water-Soluble Resin

Given as examples of the aforementioned water-soluble resin are resins having a hydroxyl group as a hydrophilic structure unit, such as polyvinyl alcohol (PVA), cation modified polyvinyl alcohol, anion modified polyvinyl alcohol, silanol modified polyvinyl alcohol, polyvinylacetal, cellulose type resins (e.g., methyl cellulose (MC), ethyl cellulose (EC), hydroxyethyl cellulose (HEC) and carboxymethyl cellulose (CMC)), chitins, chitosans and starch; resins having an ether bond, such as polyethylene oxide (PEO), polypropylene oxide (PPO), polyethylene glycol (PEG) and polyvinyl ether (PVE); and resins having an amide group or an amide bond, such as polyacrylamide (PAAM) and polyvinylpyrrolidone (PVP).

Polyacrylates, maleic acid resins, alginates and gelatins which have a carboxyl group as a dissociable group are also exemplified.

Among the above examples, particularly polyvinyl alcohols are preferred.

The content of the above water-soluble resin is preferably 9 to 40 mass % and more preferably 16 to 33 mass % based on the mass of the total solid of the colorant receptor layer.

When the aforementioned content is less than 9 mass %, the film strength is reduced, affording opportunity for the occurrence of cracks during drying. When the content exceeds 40 mass %, voids are clogged by the resin, with the result that the void ratio is decreased and there is therefore the case where the ink-absorbing ability is lowered.

The aforementioned inorganic pigment fine particle and water-soluble resin which are major components constituting the colorant receptor layer may respectively be either a single material or a mixed system of plural materials.

Also, in view of transparency, the type of resin to be combined with a the silica fine particle is important. When the above silica anhydride is used, polyvinyl alcohol (PVA) is preferable as the water-soluble resin. Among these alcohols, PVAs having a saponification value of 70 to 99% are more preferable and PVAs having a saponification value of 70 to 90% are particularly preferable.

The above PVA has a hydroxyl group in its structural unit. This hydroxyl group and a silanol group on the surface of the silica fine particle form a hydrogen bond to thereby make it easy to form a three-dimensional network structure in which the chain unit is a secondary particle of the silica fine particle. It is considered that by the formation of the above three-dimensional network structure, a colorant receptor layer having a porous structure with a high void ratio can be formed.

In ink jet recording, the porous colorant receptor layer obtained in the above manner absorbs ink quickly by the capillary phenomenon and can form a good circular dot free from ink bleeding.

Ratio of the content of the inorganic pigment fine particle to the content of the water-soluble resin The ratio (PB ratio (i:p), the mass of the inorganic pigment fine particle based on 1 part by mass of the water-soluble resin) of the content of the inorganic pigment fine particle (preferably a silica fine particle; i) to the content of the water-soluble resin (p) greatly affects the film structure of the colorant receptor layer. Specifically, if the PB ratio is increased, the void ratio, pore volume and surface area (per unit mass) are increased.

Concretely, the above PB ratio (i:p) is preferably 1.5:1 to 10:1. If the PB ratio exceeds 10:1, namely excessively large, the film strength is decreased and there is the case where cracks tend to be caused during drying. On the other hand, if the PB ratio is less than 1.5:1, namely excessively small, voids are easily clogged by the resin and there is therefore the case where the void ratio decreases, resulting in reduced ink-absorbing ability.

When the recording sheet is passed through the carriage system of an inkjet printer, stress is occasionally applied to the recording sheet. It is therefore required for the colorant receptor layer to have sufficient film strength. It is also required for the colorant receptor layer to have sufficient film strength to prevent cracks and peeling of the colorant receptor layer when the recording sheet is cut into a sheet-like form.

In this case, the PB ratio is preferably 5:1 or less and with the view of securing a high rate of ink-absorbing ability in an ink jet printer, the PB ratio is preferably 2:1 or more.

For example, when a coating solution prepared by completely dispersing the silica anhydride fine particle having an average primary particle diameter of 20 nm and the water-soluble resin in an aqueous solution at a PB ratio of 2:1 to 5:1 is applied to the support and dried, a three-dimensional network structure in which the chain unit is a secondary particle of the silica fine particle is formed, whereby a light transmittable porous film having an average pore diameter of 30 nm or less, a void ratio of 50% to 80%, a pore specific volume of 0.5 ml/g or more and a specific surface area of 100 $m^2/g$ or more can be easily formed.

Crosslinking Agent

In the ink jet recording sheet of the present invention, it is preferable to further use a crosslinking agent which can crosslink the above water-soluble resin in the colorant receptor layer.

A solution of the above crosslinking agent is preferably applied at the same time as a coating solution (coating solution for the colorant receptor layer) for forming the porous colorant receptor layer is applied or before a coating layer formed by applying the coating solution for the colorant receptor layer shows a falling drying rate. This operation effectively prevents the occurrence of cracks while the coating layer is dried. Specifically, the crosslinking solution penetrates into the coating layer at the same time as the coating solution is applied or before the coating layer shows a falling drying rate and reacts with the water-soluble resin rapidly in the coating layer to allow the water-soluble resin to gel (cure), thereby remarkably improving the film strength of the coating layer instantly.

As the crosslinking agent which can crosslink the above water-soluble resin, a type suitable in relation to the water-soluble resin to be used in the colorant receptor layer may be selected properly. Among these types, boron compounds are preferable in view of high crosslinking reaction rate. Examples of the boron compound may include borax, boric acid, borates (e.g., an orthoborate, $InBO_3$, $ScBO_3$, $YBO_3$, $LaBO_3$, $Mg_3(BO_3)_2$ and $Co_3(BO_3)_2$), diborates (e.g., $Mg_2B_2O_5$ and $Co_2B_2O_5$), methaborates (e.g., $LiBO_2$, $Ca(BO_2)_2$, $NaBO_2$ and $KBO_2$), tetraborates (e.g., $Na_2B_4O_7 \cdot 10H_2O$), pentaborates (e.g., $KB_5O_8 \cdot 4H_2O$, $Ca_2B_6O_{11} \cdot 7H_2O$ and $CsB_5O_5$), glyoxal, melamine. formaldehyde (e.g., methylolmelamine and alkylated methylolmelamine), methylol urea, resol resins, polyisocyanates and epoxy resins. Among the above compounds, borax, boric acid and borates are preferable in the point that they are capable of crosslinking reaction rapidly. Particularly, it is more preferable to use each of these compounds in combination with polyvinyl alcohol used as the water-soluble resin.

When a gelatin is used as the water-soluble resin, the following compounds which are known as hardeners for a gelatin may be used as the crosslinking agent. Examples of these hardeners include aldehyde type compounds such as formaldehyde, glyoxal and glutaraldehyde; ketone type compounds such as diacetyl and cyclopentanedione; activated halogen compounds such as bis(2-chloroethyl urea)-2-hydroxy-4,6-dichloro-1,3,5-triazine and 2,4-dichloro-6-S-triazine. sodium salt; activated vinyl compounds such as divinylsulfonic acid, 1,3-vinylsulfonyl-2-propanol, N,N'-ethylenebis(vinylsulfonylacetamide) and 1,3,5-triacryloyl-hexahydro-S-triazine; N-methylol compounds such as dimethylol urea and methyloldimethylhydantoin; isocyanate type compounds such as 1,6-hexamethylenediisocyanate; aziridine compounds described in the patent specification of U.S. Pat. No. 3,017,280 and the patent specification of U.S. Pat. No. 2,983,611; carboxyimide type compounds described in the patent specification of U.S. Pat. No. 3,100,704; epoxy type compounds such as glycerol triglycidyl ether; ethyleneimino type compounds such as 1,6-hexamethylene-N,N'-bisethylene urea; halogenated carboxyaldehyde type compounds such as mucochloric acid and mucophenoxychloric acid; dioxane type compounds such as 2,3-dihydroxydioxane; chrome alum, potassium alum, zirconium sulfate and chromium acetate.

The above crosslinking agents may be used either singly or in combinations of two or more.

The crosslinking agent solution is prepared by dissolving a crosslinking agent in water and/or an organic solvent.

The concentration of the crosslinking agent in the crosslinking agent solution is preferably 0.05 to 10 mass % and particularly preferably 0.1 to 7 mass % based on the mass of the crosslinking agent solution.

As a solvent constituting the crosslinking agent solution, water is usually used and a water type mixed solvent containing an organic solvent miscible with water may also be used.

As the above organic solvent, any solvent may be used as long as the crosslinking agent is dissolved in it. Examples of the organic solvent may include alcohols such as methanol, ethanol, isopropyl alcohol and glycerin; ketones such as acetone and methyl ethyl ketone; esters such as methyl acetate and ethyl acetate; aromatic solvents such as toluene; ethers such as tetrahydrofuran and halogenated carbon type solvents such as dichloromethane.

Other Additives

The ink jet recording sheet of the present invention may further comprise the following other components according to the need.

The recording sheet may include various ultraviolet absorbers, antioxidants, singlet oxygen quenchers for suppressing deterioration of colorant receptor layer and the like.

Given as examples of the above ultraviolet absorber are cinnamic acid derivatives, benzophenone derivatives and benzotriazolylphenol derivatives. Specific examples of these derivatives include butyl α-cyano-phenyl cinnamate, o-benzotriazolephenol, o-benzotriazole-p-chlorophenol, o-benzotriazole-2,4-di-t-butylphenol and o-benzotriazole-2,4-di-t-octylphenol. Hindered phenol compounds may be used as the ultraviolet absorber and concretely, phenol derivatives in which one or more positions of 2- and 6-positions are substituted each with a branched alkyl group are preferred.

Benzotriazole type ultraviolet absorbers, salicylic acid type ultraviolet absorbers, cyanoacrylate type ultraviolet absorbers and oxalic acid anilide type ultraviolet absorbers may also be used. These ultraviolet absorbers are described in, for example, JP-A No. 47-10537, JP-A No. 58-111942, JP-A No. 58-212844, JP-A No. 59-19945, JP-A No. 59-46646, JP-A No. 59-109055, JP-A No. 63-53544, Japanese Patent Application Publication (JP-B) No. 36-10466, JP-B No. 42-26187, JP-B No. 48-30492, JP-B No. 48-31255, JP-B No. 48-41572, JP-B No. 48-54965, JP-B No. 50-10726, the specification of U.S. Pat. No. 2,719,086, the specification of U.S. Pat. No. 3,707,375, the specification of U.S. Pat. No. 3,754,919 and the specification of U.S. Pat. No. 4,220,711.

Fluorescent brightening agents may be used as the ultraviolet absorber and as the fluorescent brightening agent, cumarin type fluorescent brightening agents are exemplified. Specific examples of the cumarin type fluorescent brightening agent are described in JP-B No. 45-4699 and JP-B No. 54-5324.

Given as examples of the aforementioned antioxidant are antioxidants described in European Patent Application Laid-open No. 223739, No. 309401, No. 309402, No. 310551, No. 310552 and No. 459416, Germany Patent Application Laid-open No. 3435443, JP-A No. 54-48535, JP-A No. 60-107384, JP-A No. 60-107383, JP-A No. 60-125470, JP-A No. 60-125471, JP-A No. 60-125472, JP-A No. 60-287485, JP-A No. 60-287486, JP-A No. 60-287487, JP-A No. 60-287488, JP-A No. 61-160287, JP-A No. 61-185483, JP-A No. 61-211079, JP-A No. 62-146678, JP-A No. 62-146680, JP-A No. 62-146679, JP-A No. 62-282885, JP-A No. 62-262047, JP-A No. 63-051174, JP-A No. 63-89877, JP-A No. 63-88380, JP-A No. 66-88381, JP-A No. 63-113536, JP-A No. 63-163351, JP-A No. 63-203372, JP-A No. 63-224989, JP-A No. 63-251282, JP-A No. 63-267594, JP-A No. 63-182484, JP-A No. 1-239282, JP-A No. 2-262654, JP-A No. 2-71262, JP-A No. 3-121449, JP-A No. 4-291685, JP-A No. 4-291684, JP-A No. 5-61166, JP-A No. 5-119449, JP-A No. 5-188687, JP-A No. 5-188686, JP-A No. 5-110490, JP-A No. 5-1108437, JP-A No. 5-170361, JP-B No. 48-43295, JP-B No. 48-33212, the specification of U.S. Pat. No. 4814262 and the specification of U.S. Pat. No. 4980275.

Specific examples of the antioxidant include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis(4-hydroxyphenyl)propane, 1,1-bis(4-hydroxyphenyl)-2-ethylhexane, 2-methyl-4-methoxy-diphenylamine and 1-methyl-2-phenylindole.

The above additives may be used either singly or in combinations of two or more. These additives may be solubilized in water, dispersed or emulsified or may be encapsulated in a microcapsule.

The amount of the additives to be added is preferably 0.01 to 10 mass % of the coating solution for the colorant receptor layer.

Also, the ink jet recording sheet of the present invention may comprise various inorganic salts and a pH regulator such as an acid or alkali with the intention of improving the dispersibility of the inorganic pigment fine particle.

The ink jet recording sheet of the present invention may further comprise various surfactants for the purpose of improving the coating adaptability and the surface qualities, ion-conductive surfactants and electron-conductive metal oxide fine particles for the purpose of suppressing frictional charging and peel charging and various matt agents for the purpose of decreasing the frictional characteristics of the surface.

Support

As materials usable as the support, either transparent materials such as plastics or opaque materials such as paper may be used. In the present invention, the support is preferably a transparent support or a highly glossy and opaque support with the view of making use of the transparency of the colorant receptor layer.

Materials which can be used as the above transparent support are preferably those which are transparent and have the qualities which can stand against radiation heat when the recording sheet is used for OHPs or back-light displays. Given as examples of such a material are polyesters such as polyethylene terephthalate, cellulose esters such as nitrocellulose, cellulose acetate or cellulose acetate butylate, polysulfones, polyphenylene oxides, polyimides, polycarbonates and polyamides. Among these compounds, polyesters are preferable and polyethylene phthalates are particularly preferable. Although no particular limitation is imposed on the thickness of the above transparent support, supports having a thickness of 50 to 200 μm are preferred because of easy handling ability.

As the highly glossy and opaque support, those in which the surface on the side provided with the colorant receptor layer has a glossiness of 40% or more are preferable. The glossiness is a value found by measuring according to the method described in JIS P-8142 (Test method for glossiness of 75 degree-mirror surface of paper and paper board). Examples of materials used for the highly glossy and opaque support may include highly glossy paper such as art paper, coat paper, cast-coated paper and baryta paper used for supports for silver salt photographs, polyesters such as polyethylene terephthalate (PET), cellulose esters such as nitrocellulose, cellulose acetate and cellulose acetate butylate, highly glossy (surface calendering treatment may be performed) films which are made opaque by compounding, for example, a white pigment in plastic films such as polysulfone, polyphenylene oxide, polyimide, polycarbonate or polycarbonate films and those obtained by forming a polyolefin coating layer including or excluding a white pigment on the surface of each of the above various papers, transparent plastic films or the plastic films containing a white pigment or the like. Moreover, white pigment-containing foam polyester films (e.g., foam PET which is made to contain a polyolefin fine particle and formed with voids by stretching) may be exemplified.

Polyolefin coated paper (a paper support provided with a white pigment-containing polyolefin layer on the surface thereof which is generally used as a support for silver salt photographs and special paper provided with, for example, metal deposition layer or the like are also preferably used.

Particularly, supports for silver salt photographs which are provided with a white pigment-containing polyolefin layer, polyester (preferably PET) films provided with a white pigment-containing polyolefin layer, white pigment-containing polyester films and white pigment-containing foam polyester films are desirable.

Although no particular limitation is imposed on the thickness of the above transparent support, supports having a thickness of 50 to 300 μm are preferred because of easy handling ability.

Moreover, as the support, those processed by corona discharge treatment, glow discharge treatment, flame treatment or ultraviolet radiation treatment may be used to impart adhesion to the colorant receptor layer.

Method of Producing the Ink Jet Recording Sheet

As to a method of the production of the ink jet recording sheet according to the present invention, a coating solution obtained by dissolving or dispersing the polymer according to the present invention in water, an organic solvent or a mixed solvent of these solvents is applied to the support by using a known coating method to thereby obtain the ink jet recording sheet. However, the present invention is not limited to the above method. It is particularly preferable that the polymer according to the present invention be applied as a solution in which the polymer is dissolved in view of glossiness of the resulting coating film.

Organic Solvent

Given as examples of organic solvents usable for coating are alcohols such as methanol, ethanol, n-propanol, i-propanol and methoxy propanol, ketones such as acetone and methyl ethyl ketone, tetrahydrofuran, acetonitrile, ethyl acetate and toluene.

Method of Forming the Colorant Receptor Layer

Next, explanations will be furnished as to another embodiment of the present invention, namely, an ink jet recording sheet comprising the inorganic pigment fine particle, the water-soluble resin and the polymer according to the present invention in a colorant receptor layer.

First, examples of a method for forming the colorant receptor layer includes a method in which an aqueous dispersion (other than water, an organic solvent may be optionally combined, hereinafter called "first coating solution" as the case may be) of the inorganic pigment fine particle and the water-soluble resin is prepared, applied and the like and a coating solution (hereinafter called "second coating solution" as the case may be) containing the polymer according to the present invention which is prepared in the form of a water dispersion, organic solvent solution or solution of a mixture of water and an organic solvent is applied before the coating layer formed by coating shows a falling drying rate during drying of the coating layer. Alternatively, a method may be utilized in which the first coating solution is prepared, applied and dried to form a film and thereafter the second coating solution is applied.

In the present invention, the above first coating solution for the colorant receptor layer containing at least the inorganic pigment fine particle and the water-soluble resin may be prepared, for example, in the following manner.

Specifically, a silica fine particle having an average primary particle diameter of 20 nm or less is added (for example, 10 to 20 mass %) to water and dispersed using a high speed wet colloid mill (for example, Clearmix (manufactured by M Technique) in the condition of a rotation as high as, for example, 10000 rpm (preferably 5000 to 20000 rpm) for 20 minutes (preferably 10 to 30 minutes). Then, an aqueous polyvinyl alcohol solution is added (for example, such that that the mass of PVA is about ⅓ the mass of silica) to the dispersion and the mixture is dispersed in the same rotation condition as above whereby the first coating solution can be prepared. The resulting coating solution is a uniform sol, which is then formed on the support by coating according to the following coating method whereby a porous color receptor layer having a three-dimensional network structure can be formed.

A surfactant, a pH regulator and an antistatic agent may be added to the above first coating solution according to the need.

Examples of a method applying the above first coating solution include (1) a method of applying the first coating solution to a support or the like, (2) a method of atomizing the first coating solution by a spraying method or the like and (3) a method of dipping the support and the like in the first coating solution.

The first coating solution may be applied by a known coating method using, for example, an extrusion die coater, air doctor coater, bread coater, rod coater, knife coater, squeeze coater, reverse roll coater or bar coater.

The aforementioned term "before the coating layer shows a falling drying rate" generally indicates a period of several minutes directly after the first coating solution is applied. During this period, the coating layer shows the constant drying rate which is a phenomenon that the content of a solvent in the coating layer which is applied decreases in proportion to time. Time during which the constant drying rate is shown is described in Chemical Engineering Handbook (p.707–712, published by Maruzen, Oct. 25, 1980).

As mentioned above, the coating layer is dried until it shows a falling drying rate after the first coating solution is applied. The drying is carried out usually at 50 to 180° C. for 0.5 to 10 minutes (preferably 0.5 to 5 minutes). The drying time desirably falls in this range, although it differs depending on the amount to be applied.

Examples of a method of applying the coating solution (second coating solution) containing the polymer according to the present invention which is prepared in the form of a water dispersion, organic solvent solution or solution of a mixture of water and an organic solvent before the coating layer shows a falling drying rate include (1) a method of applying the second coating solution further on the coating layer, (2) a method of atomizing the second coating solution by a spraying method or the like and (3) a method of dipping the support formed with the coating layer in the second coating solution.

As a method of applying the second coating solution in the method (1), a known coating method using, for example, a curtain flow coater, extrusion die coater, air doctor coater, bread coater, rod coater, knife coater, squeeze coater, reverse roll coater or bar coater may be utilized. It is however preferable to use a method, in which a coater is not directly in contact with the coating layer which has been already formed, such as methods using an extrusion die coater, curtain flow coater or bar coater. In these coatings, two or more coating solutions may be applied together so as to form a multilayer.

The simultaneous coating (multilayer coating) may be carried out by a coating method using an extrusion die coater or a curtain flow coater. After this simultaneous coating is finished, the formed coating layer is dried. The drying in this case is usually carried out by heating the coating layer at 40 to 150° C. for 0.5 to 10 minutes and preferably at 40 to 100° C. for 0.5 to 5 minutes.

For example, when borax or boric acid is used as the crosslinking agent to be contained in the crosslinking solution, the coating layer is preferably heated at 60 to 100° C. for 5 to 20 minutes.

A coating solution (aqueous dispersion, or may further contain an organic solvent, hereinafter called "third coating solution" as the case may be) may be applied, the coating solution containing at least a quaternary ammonium salt and being prepared by compounding the polymer (the polymer according to the present invention) having a low inorganicity/organicity ratio (I/O value) and a low cation density with the inorganic pigment fine particle in advance and thereafter by further compounding a water-soluble resin.

As a method of preparing the above third solution, for example, a method may be used in which the polymer according to the present invention and the inorganic pigment fine particle are mixed and dispersed in water or an organic solvent which can dissolve the polymer by using a known method and the water-soluble resin or an aqueous solution of the water-soluble resin is mixed with the resulting solution.

Examples of a method of applying the third coating solution include (1) a method of applying the third coating solution to the support, (2) a method of atomizing the third coating solution by a spraying method or the like and (3) a method of dipping the support in the third coating solution.

Also, as the third coating solution, the following coating solutions may be used: a coating solution obtained by mixing the water-soluble resin or an aqueous solution of the water-soluble resin with a coating solution prepared by further dispersing a dispersion, obtained by mixing the polymer according to the present invention and the inorganic pigment fine particle, in water or an aqueous medium (which may contain a proper dispersant) and by removing an organic solvent as required or a coating solution obtained by redispersing the polymer according to the present invention and the inorganic pigment fine particle in an aqueous solution of the water-soluble resin and by removing an organic solvent as required.

Moreover, a crosslinking agent may be applied to the support by adding the crosslinking agent to any one of the above first, second and third coating solutions. The crosslinking agent may be added to two or more coating solutions among the first, second and third coating solutions. Also, a coating solution containing the crosslinking agent may be prepared separately from the first, second and third coating solutions and applied in any stage of coating steps.

Also, in each step of the above coatings, water, an organic solvent or a mixture of these solvents may be used as the solvent. Examples of the organic solvent which can be used for this coating include alcohols such as methanol, ethanol, n-propanol, i-propanol and methoxy propanol, ketones such as acetone and methyl ethyl ketone, tetrahydrofuran, acetonitrile, ethyl acetate and toluene.

After the colorant receptor layer is formed on the support, the colorant receptor layer is processed by calendering treatment performed by passing it between roll nips under heating and pressuring by using a super calender or gloss calender, whereby the surface smoothness, glossiness, transparency and film strength of the sheet can be improved. However, the above calendering treatment sometimes causes the void ratio to be reduced (namely, the ink-absorbing ability is sometimes reduced). It is therefore necessary to fix a condition under which a reduction in the void ratio is suppressed.

The temperature of the roll when the calendering treatment is performed is preferably 30 to 150° C. and more preferably 40 to 100° C.

The line pressure between the rolls in the calendering treatment is preferably 50 to 400 kg/cm and more preferably 100 to 200 kg/cm.

The layer thickness of the above colorant receptor layer must be determined in relation to the void ratio of the layer because it must have absorbing capacity enough to absorb all liquid droplets in the case of ink jet recording. For example, when the amount of ink is 8 nL/mm$^2$ and the void ratio is 60%, a film having a layer thickness of about 15 $\mu$m or more is required.

Considering this point, in the case of ink jet recording, the layer thickness of the colorant receptor layer is preferably 10 to 50 $\mu$m.

The pore diameter of the colorant receptor layer is preferably 0.005 to 0.030 $\mu$m and more preferably 0.01 to 0.025 $\mu$m in terms of median diameter.

The above void ratio and the pore median diameter may be measured using a mercury porosimeter (trademark: Bore Sizer 9320-PC2, manufactured by Shimazu Corporation)

Also, the colorant receptor layer is preferably transparent. To state the criteria of transparency, the haze value when the colorant receptor layer is formed on a transparent support is preferably 30% or less and more preferably 20% or less.

The above haze value can be measured using a haze meter (HGM-2DP, manufactured by Suga Shikenki).

An undercoat layer may be formed on the support to raise adhesion between the colorant receptor layer and the support and to regulate electric resistance.

The colorant receptor layer may be provided either on only one surface of the support or on both surfaces of the support to suppress deformations such as curling. When the recording sheet is used in, for example, OHPs and the colorant receptor layer is provided on only one surface of the support, an anti-reflection coating may be formed on the opposite surface or each of both surfaces to improve the light transmittance.

Also, boric acid or a boron compound is applied on the surface of the support on the side where the colorant layer is to be formed and thereafter the colorant receptor layer is formed on the surface, making it possible to secure the glossiness and surface smoothness of the colorant receptor layer and to suppress the bleeding of an image with time under high temperature and humidity after the image is formed. Also, the colorant receptor layer contains the inorganic pigment fine particle and forms a three-dimensional network structure having a void ratio of 50 to 80%, good ink-absorbing ability is exhibited, a high resolution and density image can be formed and such an ink-receiving capability that the formed image has high light resistance and water resistance can be secured.

EXAMPLES

The present invention will be explained in more detail by way of examples, which are not intended to limit the scope of the present invention, in which all designations of "parts" and "%" indicate "parts by mass" and "mass %" respectively.

Synthetic Example 1

<Synthesis of Trihexyl-Vinylbenzylammonium Chloride>

40.0 parts of chloromethylstyrene (mixture of a p-isomer and m-isomer), 60.0 parts of trihexylamine and 0.6 parts of hydroquinone monomethyl ether were dissolved in 130 parts of acetonitrile and the solution was heated with stirring at 85° C. for 7 hours. Then, the reaction solution was washed with 110 parts of hexane and the acetonitrile solution was concentrated to dryness. The concentrate was recrystallized from ethyl acetate to obtain 52.7 parts of a colorless crystal of trihexyl-vinylbenzylammonium chloride.

<Synthesis of Poly(trihexyl-Vinylbenzylammonium Chloride)>

50.0 parts of trihexyl-vinylbenzylammonium chloride was dissolved in 45.0 parts of ethanol. The solution was heated at 60° C. in a nitrogen stream and a solution of 0.19 parts of AIBN (2,2'-azobisisobutyronitrile) and 5.0 parts of ethanol was added. The mixture was stirred under heating at 60° C. for 5 hours.

A solution of 146 parts of ethanol was added to the reaction solution and the resulting solution was poured into 2000 parts of water with stirring. The produced solid was subjected to filtration and dried to obtain 39.0 parts of a white solid of poly(trihexyl-vinylbenzylammonium chloride) (polymer 1 shown as above).

Example 1

Production of a Substrate

Wood pulp consisting of 100 parts of LBKP was beaten to a Canadian freeness of 300 ml by a double disc refiner. 0.5 parts of epoxidated behenic acid amide, 1.0 parts of anion polyacrylamide, 0.1 parts of polyamidepolyamine epichlorohydrin and 0.5 parts of cation polyacrylamide were added wherein each amount was shown in terms of bone dry mass ratio based on the pulp to produce base paper having an area weight of 170 g/m$^2$ by a Fourdrinier paper Machine.

To regulate the surface size of the above base paper, 0.04% of a fluorescent whitening agent (Whitex BB, manufactured by Sumitomo Chemical) was added to an aqueous 4% polyvinyl alcohol solution and the base paper was impregnated with the prepared solution such that the amount of the solution was 0.5 g/m$^2$ converted into bone dry mass, followed by drying. Thereafter, the base paper was subjected to calendering treatment to obtain a substrate paper adjusted to a density of 1.05.

The wire surface (backface) side of the resulting substrate paper was processed by corona discharge treatment and then coated with high density polyethylene using a melt extruder such that the thickness of the polyethylene film was 19 $\mu$m to form a resin layer consisting of a matt surface (hereinafter, the resin layer surface is called "backface" as the case may be). The resin layer on the backface side was processed by corona discharge treatment and a dispersion obtained by dispersing aluminum oxide (Alumina Sol 100, manufactured by Nissan Chemical Industries) and silicon dioxide (Snowtex O, manufactured by Nissan Chemical Industries) as antistatic agents in a ratio (mass ratio) of 1:2 was applied such that the mass after dried was 0.2 g/m$^2$.

Also, the felt surface (front surface) side of the base paper was processed by corona discharge treatment. Then, low density polyethylene which contained 10 mass % of anatase type titanium dioxide, a minute amount of ultramarine blue and 0.01 mass % (based on polyethylene) of a fluorescent whitening agent and had a MFR (melt flow rate) of 3.8 was melt-extruded using a melt-extruder such that the thickness was 29 $\mu$m to form a thermoplastic resin layer having a glossy surface (hereinafter this surface is called "surface" as the case may be) on the above substrate paper. The resulting substrate paper was used as a support.

Preparation of a Coating Solution for a Colorant Receptor Layer (1) and (2) in the composition described below were mixed and the mixture was dispersed using a high speed rotating type colloid mill (Clearmix, manufactured by M Technique) in the condition of 10000 rpm for 20 minutes. In succession, an aqueous 9% polyvinyl alcohol solution (3) described below was added to the mixture and the resulting mixture was further dispersed in the same conditions as above to prepare a coating solution for a colorant receptor layer. The ratio by mass (PB ratio) of a silica fine particle to a water-soluble resin was 3.5:1.

<Composition of a Coating Solution for a Colorant Receptor Layer>

| | |
|---|---|
| (1) Silica fine particle<br>(inorganic pigment fine particle)<br>(average primary particle diameter: 7 nm, Aerosil 300, manufactured by Nippon Aerosil) | 9.9 parts |
| (2) Ion exchange water | 73.1 parts |
| (3) Aqueous 9% polyvinyl alcohol solution<br>(PVA420, manufactured by Kuraray, saponification value: 81.8%, degree of polymerization: 2000) | 31.6 parts |

Production of the Ink Jet Recording Sheet of the Present Invention

Next, the coating solution for a colorant receptor layer obtained as above was applied on the aforementioned support in an amount of 200 ml/m$^2$ by using an extrusion die coater (coating step) and dried using a hot air drier at 80° C. (air rate: 3 to 8 m/sec) such that the solid content of the coating layer was 20%. The coating layer showed the constant drying rate during this period. The support was dipped in a coating solution (solution containing a polymer and a crosslinking agent) having the composition shown below for 30 seconds just after the coating layer was dried, to make the coating solution adhere to the coating layer in an amount of 20 g/m$^2$ (step of applying a solution containing a polymer and a crosslinking agent). After that, the coating solution was dried at 80° C. for 10 minutes (drying step).

A colorant receptor layer having a dry film thickness of 32 $\mu$m was formed on the support in this manner to manufacture an ink jet recording sheet according to the present invention.

<Composition of a Coating Solution Containing a Polymer and a Crosslinking Agent>

| | |
|---|---|
| (1) Boric acid (crosslinking agent) | 1.8 parts |
| (2) Aqueous 10% surfactant solution<br>(F144D, manufactured by Dainippon Ink and Chemicals) | 2.4 parts |
| (3) Ethanol | 103.5 parts |
| (4) Poly(trihexyl-vinylbenzylammonium chloride)<br>(polymer 1 shown as above) | 7.1 parts |

Method of Evaluation (1-1) Ink Absorbing Rate

Using an ink jet printer (PM-770C, manufactured by Seiko Epson), solid images of Y (yellow), M (magenta), C (cyan), K (black), B (blue), G (green) and R (red) were printed and immediately (after about 10 seconds), paper was brought into contact with the images and pressed thereto to rate the presence of transfer of ink to the paper according to the following standard.

Standard

AA: Transfer of ink to the paper was not found at all. This shows that the ink absorbing rate is high.

CC: Transfer of a part of ink to the paper was observed.

(1-2) Occurrence of cracks

The presence and size of cracks which occurred on the surface of the ink jet recording sheet were visually observed and evaluated according to the following standard.

Standard

AA: No crack was observed at all.

BB: Cracks 1–2 mm in length were observed.

CC: Cracks 3 mm or more in length were observed. (1-3) Water resistance

Using the same printer as in the above (1-1), the same print pattern was formed on the ink jet recording sheet, which was then allowed to stand for 3 hours and dipped in water for one minute and the degree of flow-out of ink into water was visually observed to evaluate according to the following standard.

Standard

AA: The flow-out of a dye was not observed at all.

BB: A part from which a dye flowed out was observed and the color density was decreased.

CC: All of a dye flowed into water completely. (1-4) Bleeding with time

Using the same printer as in the above (1-1), a lattice-like line pattern (line width: 0.28 mm) in which magenta ink was positioned side by side with black ink was printed. The sheet was allowed to stand for 3 hours after the pattern was printed and then stored in a thermohygrostat kept at 40° C. and a relative humidity of 90%. The line width of the black portion was measured to evaluate according to the following standard.

Standard

AA: The occurrence of bleeding with time was not almost observed, showing good print conditions. (Line width: 0.28 to 0.30 mm)

BB: Slight bleeding with time was observed; however, it is of a practically no-problem level. (Line width: 0.31 to 0.35 mm)

CC: Significant bleeding with time was observed and it is of a practically problem level. (Line width: 0.35 or more)

The results obtained by these evaluations are shown in Table 1 shown below.

Examples 2 to 5

Ink jet recording sheets were produced in the same manner as in Example 1 except that the polymer 1 was altered to the polymers 2, 3, 4, 5 and 6 as mentioned above respectively and evaluated in the same manner as in Example 1. The results are shown in Table 1 shown below.

Comparative Examples 1 to 3

Ink jet recording sheets were produced in the same manner as in Example 1 except that the polymer 1 was altered to the comparative polymers 1 to 3 shown below respectively and evaluated in the same manner as in Example 1. The results are shown in Table 1 shown below.

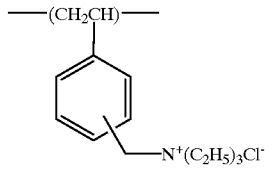

Comparative polymer 1 (I/O value=1.38, cation density=4.81 meq/g)

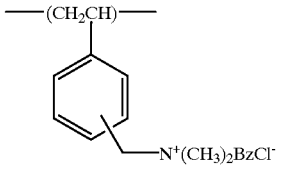

Comparative polymer 2 (I/O value=1.19, cation density=3.47 meq/g)

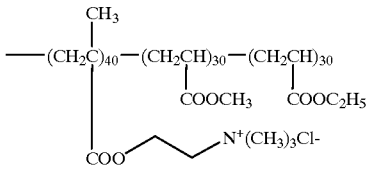

Comparative polymer 3 (I/O value=1.75, cation density=2.88 meq/g)

TABLE 1

| | Example 1 | Example 2 | Example 3 | Example 4 | Example 5 | Comp. Example 1 | Comp. Example 2 | Comp. Example 3 |
|---|---|---|---|---|---|---|---|---|
| | Mordant | | | | | | | |
| | Polymer 1 | Polymer 2 | Polymer 3 | Polymer 4 | Polymer 5 | Comp. Polymer 1 | Comp. Polymer 2 | Comp. Polymer 3 |
| Ink-absorbing rate | AA | AA | AA | AA | AA | AA | AA | AA |
| Cracks | AA | AA | AA | AA | AA | AA | AA | AA |
| Water resistance | AA | AA | AA | AA | AA | AA | AA | BB |
| Bleeding with time | AA | AA | AA | AA | AA | BB | BB | CC |

From Table 1, the occurrence of bleeding with time was not observed in the case of the ink jet recording sheets of the present invention using the polymers 1 to 5 having an I/O value of 1 or less and a cation density of 3 meq/g or less respectively. Further, good results were obtained as to the ink absorbing rate, cracks on the surface of the recording sheet and water resistance.

On the other hand, in the case of using, as a mordant, the comparative polymers 1 to 3 having an I/O value of 1 or more and/or a cation density exceeding 3 meq/g, the occurrence of bleeding with time was observed. Particularly in the case of using the comparative polymer 3 having an I/O value of 1.75, such a result that the occurrence of bleeding with time was significantly observed and the water resistance was low was obtained.

Example 6 and Comparative Example 4

Production of a Substrate

Wood pulp consisting of 80 parts of LBKP and 20 parts of NBKP was beaten to a Canadian freeness of 430 ml by a double disc refiner. 10 parts of kaolin, 0.4 parts of starch made cationic, 0.2 parts of polyacrylamide and 0.075 parts of a neutral rosin sizing agent were added wherein each amount was shown in terms of bone dry mass ratio based on the pulp to produce base paper having an area weight of 80 $g/m^2$ by a Fourdrinier paper Machine.

An ethanol solution of 20 mass % of the polymer 1 shown in synthetic Example 1 was applied to the base paper such that the amount to be applied after dried was 2 $g/m^2$ to obtain a recording sheet.

Also, as Comparative Example 4, one using the base paper as it was without coating as described above was subjected to evaluation.

Method of Evaluation (2-1) Image Density

Using an ink jet printer (PM-770C, manufactured by Seiko Epson), a solid image of K (black) was printed and allowed to stand for three hours. The reflection density of the print surface was measured by a Macbeth reflection densitometer.

(2-2) Water Resistance

Using the same printer as in the above (2-1), solid images of Y (yellow), M (magenta), C (cyan), K (black), B (blue), G (green) and R (red) were printed on the ink jet recording sheet, which was then allowed to stand for 3 hours and dipped in water for one minute and the degree of flow-out of ink into water was visually observed to evaluate according to the following standard.

Standard

AA: The flow-out of a dye was not observed at all.

BB: A part from which a dye flowed out was observed and the color density was decreased.

CC: All of a dye flowed into water completely.

The results obtained by these evaluations are shown in Table 2 shown below.

TABLE 2

| | Example 6 | Comparative Example 4 |
|---|---|---|
| Mordant | Polymer 1 | None |
| Image density | 1.38 | 1.02 |
| Water resistance | AA | CC |

It is found from Table 2 that the image density is higher and the occurrence of flow-out with time is also remarkably decreased in the case of applying the polymer 1 of the present invention directly to the support than in the case of using no mordant.

Comparing the case of compounding the polymer according to the present invention in the colorant receptor layer disposed on the substrate and including the inorganic pigment fine particle and the water-soluble resin in Examples 1 to 5 with the case of applying the polymer according to the present invention directly to the support in Example 6, the ink jet recording sheets obtained in Examples 1 to 5 can more suppress the occurrence of bleeding with time.

According to the present invention, an ink jet recording sheet can be provided which is free from bleeding with time and can keep an image stably even if it is stored for a long period of time under high temperature and humidity after an image is printed.

Also, according to the present invention, an ink jet recording sheet can be provided which can avoid the occurrence of cracks, is strong, has high surface glossiness, possesses high ink-absorbing ability, can form an image with high resolution and high density, has good color-developing ability and is superior in the light resistance and water resistance of an image portion.

What is claimed is:

1. An ink jet recording sheet for receiving ink in ink jet image recording methods comprising a support and a colorant receptor layer on said support, said colorant receptor layer containing: inorganic pigment fine particles having an average primary particle diameter of 20 nm or less; a water-soluble resin; and a polymer which contains a quaternary ammonium base, said polymer having an inorganicity/organicity ratio calculated based on an organic conceptual diagram of at most 1.0 and a cation density of at most 3.0 meq/g, and said polymer being soluble in at least one of water and an organic solvent.

2. An ink jet recording sheet for receiving ink in ink jet image recording methods according to claim 1, wherein said colorant receptor layer further contains a crosslinking agent capable of crosslinking said water-soluble resin.

3. An ink jet recording sheet for receiving ink in ink jet image recording methods according to claim 2, wherein said crosslinking agent is a boron compound.

4. An ink jet recording sheet for receiving ink in ink jet image recording methods according to claim 1, wherein said inorganic pigment fine particles are silica fine particles having an average primary particle diameter of at most 20 nm.

5. An ink jet recording sheet for receiving ink in ink jet image recording methods according to claim 1, wherein said water-soluble resin is one of a polyvinyl alcohol and a derivative of a polyvinyl alcohol.

6. An ink jet recording sheet for receiving ink in ink jet image recording methods according to claim 1, wherein said colorant receptor layer has a three-dimensional network structure having a void ratio of from 50 to 80%, and an i:p mass ratio of content of said inorganic pigment fine particles i to content of said water-soluble resin p is from 1.5:1 to 10:1.

7. An ink jet recording sheet for receiving ink in ink jet image recording methods according to claim 1, wherein said polymer has an inorganicity/organicity ratio calculated based on the organic conceptual diagram of at most 0.8 and a cation density of at most 2.5 meq/g.

8. An ink jet recording sheet for receiving ink in ink jet image recording methods according to claim 7, wherein said colorant receptor layer further contains a crosslinking agent capable of crosslinking said water-soluble resin.

9. An ink jet r cording sheet for receiving ink in ink jet image recording methods according to claim 8, wherein said crosslinking agent is a boron compound.

10. An ink jet recording sheet for receiving ink in ink jet image recording methods according to claim 7, wherein said inorganic pigment fine particles are silica fine particles having an average primary particle diameter of at most 20 nm.

11. An ink jet recording sheet for receiving ink in ink jet image recording methods according to claim 7, wherein said water-soluble resin is one of a polyvinyl alcohol and a derivative of a polyvinyl alcohol.

12. An ink jet recording sheet for receiving ink in ink jet image recording methods according to claim 7, wherein said colorant receptor layer has a three-dimensional network structure having a void ratio of from 50 to 80%, and an i:p mass ratio of content of said inorganic pigment fine particles i to content of said water-soluble resin p is from 1.5:1 to 10:1.

13. An ink jet recording sheet for receiving ink in ink jet image recording methods according to claim 1, wherein said colorant receptor layer is obtained by applying to said support, for forming a coating layer, a first coating solution containing said inorganic pigment fine particles having an average primary particle diameter of 20 nm or less and said water-soluble resin, and applying a second coating solution containing said polymer at at least one time of a time when the first coating solution is applied, a time during drying of said coating layer before said coating layer shows a falling drying rate, and a time after said coating layer has dried and formed a coating film.

14. An ink jet recording sheet for receiving ink in ink jet image recording methods according to claim 1, wherein said colorant receptor layer is obtained by applying a third coating solution, which is produced by mixing said inorganic pigment fine particles having an average primary particle diameter of 20 nm or less with said polymer in advance and then mixing said water-soluble resin therewith.

15. An ink jet recording sheet for receiving ink in ink jet image recording methods according to claim 7, wherein said colorant receptor layer is obtained by applying to said support, for forming a coating layer, a first coating solution containing said inorganic pigment fine particles having an average primary particle diameter of 20 nm or less and said water-soluble resin, and applying a second coating solution containing said polymer at at least one time of a time when the first coating solution is applied, a time during drying of said coating layer before said coating layer shows a falling drying rate, and a time after said coating layer has dried and formed a coating film.

16. An ink jet recording sheet for receiving ink in ink jet image recording methods according to claim 7, wherein said colorant receptor layer is obtained by applying a third coating solution, which is produced by mixing said inorganic pigment fine particles having an average primary particle diameter of 20 nm or less with said polymer in advance and then mixing said water-soluble resin therewith.

17. An ink jet recording sheet for receiving ink in ink jet image recording methods according to claim 2, herein said colorant receptor layer is obtained by one of applying to said support at least a solution prepared by adding said crosslinking agent to a coating solution which contains at least one of said polymer, said inorganic pigment fine particles having an average primary particle diameter of 20 nm or less and said water-soluble resin and applying to said support a coating solution containing said crosslinking agent and at least one other coating solution containing at least one of said polymer, said inorganic pigment fine particles having an average primary particle diameter of 20 nm or less and said water-soluble resin.

18. An ink jet recording sheet for receiving ink in ink jet image recording methods according to claim 8, wherein said colorant receptor layer is obtained by one of applying to said support at least a solution prepared by adding said crosslinking agent to a coating solution which contains at least one of said polymer, said inorganic pigment fine particles having an average primary particle diameter of 20 nm or less and water-soluble resin and applying to said support a coating solution containing said crosslinking agent and at least one other coating solution containing at least one of said polymer, said inorganic pigment fine particles having an average primary particle diameter of 20 nm or less and said water-soluble resin.

* * * * *